US005374921A

United States Patent [19]

Martin et al.

[11] Patent Number: 5,374,921

[45] Date of Patent: Dec. 20, 1994

[54] FIBRE OPTIC SECURITY AND COMMUNICATIONS LINK

[75] Inventors: Brian W. Martin; Gary B. Loubert, both of Kanata, Canada

[73] Assignee: Instantel Inc., Ontario, Canada

[21] Appl. No.: 791,195

[22] Filed: Nov. 13, 1991

[51] Int. Cl.[5] ..... G08B 1/08

[52] U.S. Cl. ..... 340/539; 340/555; 340/568; 340/693; 359/127

[58] Field of Search ..... 340/539, 555, 556, 571, 340/572, 573, 568, 815.31, 693; 359/127

[56] References Cited

U.S. PATENT DOCUMENTS

| | | | |
|---|---|---|---|
| 4,250,498 | 2/1981 | Walter | 340/693 |
| 4,546,345 | 10/1985 | Naito | 340/555 |
| 4,853,692 | 8/1989 | Wolk et al. | 340/572 |
| 5,014,040 | 5/1991 | Weaver et al. | 340/572 |
| 5,075,670 | 12/1991 | Bower et al. | 340/572 |

*Primary Examiner*—Donnie L. Crosland
*Attorney, Agent, or Firm*—Antonelli, Terry, Stout & Kraus

[57] ABSTRACT

A beacon is contained in a waterproof housing which is devoid of any electrical contact points. At a location at which a signal is to be applied to or received from the beacon, the housing is made sufficiently thin to allow light to pass therethrough. A light energy transmitter coupled to receive the signal to be transmitted into or out of the housing is located immediately adjacent or abutted against the translucent portion of the housing. A light energy receiver is similarly disposed adjacent or abutted against the other side of the housing, to receive the light energy. In this manner no electrical contacts need pass through the housing, and the beacon circuit is entirely protected by the waterproof housing, from water, soap, sweat, body oils, etc.

14 Claims, 2 Drawing Sheets

FIBRE OPTIC SECURITY AND COMMUNICATIONS LINK

FIELD OF THE INVENTION

This invention relates to a structure for communicating signals to and from a radio frequency telemetry beacon contained in a waterproof housing without requiring electrical contacts to pass through the housing. The invention is useful in a patient locator, in which the housing is in the form of a wrist watch case.

BACKGROUND TO THE INVENTION

Miniature radio frequency transmitters have been designed that are usually worn on the wrist, ankle or elsewhere by a person who, for various reasons, needs to be prevented from entering or leaving certain surroundings. Examples of such persons are medical patients who are suffering from Alzheimer's disease who have a tendency to become confused and wander away from safe surroundings, inmates who are serving sentences either in institutions or half-way houses or in their own homes, and newly born infants in hospitals who may be stolen by distressed adults or professionals. A transmitter attached to such a person, operating as a beacon, triggers a radio frequency receiver when it is adjacent a building exit, and warns of the exiting of the transmitter and therefore of the person.

Such transmitters are usually housed in a wrist watch type of case, with a strap around the wrist or ankle. A wire in the strap is connected at two points through the housing, one of those points to the transmitter. A signal such as a direct current is transmitted through the wire, and is received by a receiver also contained in the housing, whereby the retention of the strap in place can be verified.

If it is desired to remove the beacon without authorization, one of the techniques is to cut the strap. This interrupts the signal, and as a result the beacon transmits a special alarm signal.

However a resourceful person could find the means to short circuit the wire at the two points of entry to the housing, or at some other suitable point, thus maintaining the continuity of the circuit. It has therefore been found that such straps are unreliable, since they can be defeated.

Since the beacon in the housing is worn at all times, including when bathing or showering, the transmitter must be housed in a waterproof container. This creates technical problems in bringing electrical contacts for connection to the external wire out of the housing. The presence of water, soaps, sweat and body oils necessitates the connect point to the embedded wire should be gas and water tight to prevent corrosion and consequent device malfunctioning.

Further, it has been found that the presence of the wire in the strap has undesirable effects on the radiation patterns of the radio frequency transmitter of the beacon.

SUMMARY OF THE PRESENT INVENTION

All of the above-noted problems have been solved by containing the beacon in a waterproof housing which is devoid of such electrical contact points. At a location at which a signal is to be applied to or received from the beacon, the housing is made sufficiently thin to allow light to pass therethrough. A light energy transmitter coupled to receive the signal to be transmitted into or out of the housing is located immediately adjacent or abutted against the translucent portion of the housing. A light energy receiver is similarly disposed adjacent or abutted against the other side of the housing, to receive the light energy.

In this manner no electrical contacts need pass through the housing, and the beacon circuit is entirely protected by the waterproof housing, from water, soap, sweat, body oils, etc.

In the patient, person or object locator embodiment of the invention, two portions of the housing are made sufficiently thin so as to be translucent, and an optical fiber, preferably contained within a strap for encircling the person or object, has its ends abutted against the translucent portions. An optical energy transmitter is disposed inside the waterproof housing adjacent one end of the fiber and an optical energy receiver is disposed inside the waterproof housing adjacent the other end of the optical fiber, the transmitter and receiver being driven by the electronic circuit within the housing. Light energy is transmitted through the optical fiber, the transmitted and received energy being compared. This provides an indication that the strap is in place. If the signals do not correspond, this is an indication that the strap has been removed, or of a malfunction of the optical fiber, and an alarm beacon can be transmitted.

Since the encircling structure is an optical fiber, a person would not normally be able to defeat the device by connecting a wire or any other common material between broken ends of the fiber or between the translucent portions of the housing. The structure is therefore much more reliable than prior art structures.

In order to ensure ambient light does not substitute for the light transmitted from the circuit contained within the housing, it is preferred that a pulse form of light energy signal should be used.

Thus the present invention does not contain corrosive contacts, is waterproof, and light can go right through the sealed housing without disturbing the operation of the beacon.

It should also be noted that in addition to or in substitution for use of an optical fiber encircling the person or object, the translucent portion of the housing in combination with an optical energy transmitter and/or receiver can be used for both communicating with and programing the electronic circuit contained within the housing. For example, an optical energy signal can be transmitted through the housing to beacon telemetry circuitry within the housing, which signal can be derived from an electrocardiogram on a patient. The electronic circuit can be used to transmit signals representative of any biological function which can be monitored and translated into an electronic, and thus a light energy signal. Thus a person can be mobile, and yet be biologically monitored.

An identification code electronically stored by the circuitry within the housing can be changed, the circuit can be tested, the mode it operates at can be changed, its frequency can be changed, its emission can be measured without radiation, it can be calibrated, its battery level interrogated, diagnostics of the circuitry can be read, etc., without electrical contact, and without requiring its removal or the opening of the waterproof housing. Thus the waterproof housing may be permanently sealed. The permanently sealed housing affords increased reliability since it cannot be casually opened and tampered with.

The present invention clearly is substantially improved over prior art structures, and affords considerable advantages thereover.

In accordance with an embodiment of the invention, a body strap for retaining a radio frequency beacon disposed in a housing to a body is comprised of an optical fiber for encircling a body part, the ends of the optical fiber abutting a side or sides of the housing, whereby light energy may be coupled from the housing into one end of the optical fiber, and the coupled light energy may be received in the housing from the other end of the fiber.

In accordance with another embodiment, a beacon disposed in a housing for attachment to a person or object is comprised of a strap retaining an optical fiber for encircling a body part or the object with the strap, the ends of the optical fiber being abutted to a side or sides of the housing, apparatus for coupling light energy from the housing into one end of the optical fiber, and apparatus in the housing for receiving the light energy, whereby a comparison may be made of the transmitted and received light energy and the presence, absence or malfunction of the optical fiber determined.

In accordance with another embodiment, a waterproof housing is provided for retaining and protecting an electronic circuit, the housing having at least one portion which is translucent, and apparatus for coupling light energy representative of a signal to be transmitted out of the housing or into the housing disposed adjacent one side of the translucent portion, and apparatus for receiving the light energy disposed adjacent the other side of the translucent portion, whereby the light energy may be coupled through the translucent portion of the waterproof housing.

BRIEF INTRODUCTION TO THE DRAWINGS

A better understanding of the invention will be obtained by reference to the detailed description below, in conjunction with the following drawings, in which:

FIG. 1 illustrates in partial cross-section the elements of a preferred embodiment of the present invention; and FIG. 2 is a block diagram of electronic portion of the invention.

DESCRIPTION OF THE PREFERRED EMBODIMENT OF THE INVENTION

Figure 1:
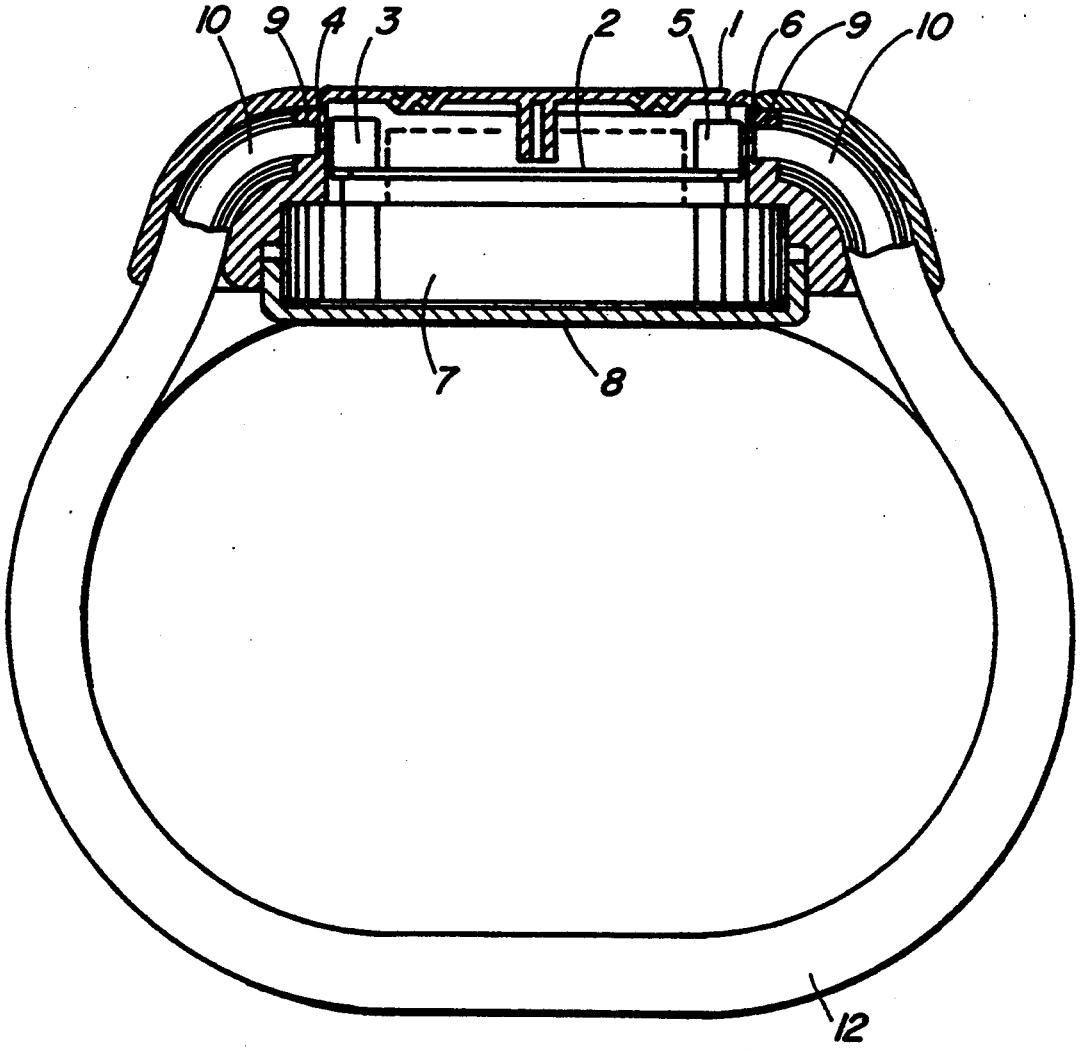

In FIG. 1, a sealed, waterproof housing 1, formed of translucent plastics material such as Nylon TM, 0 contains an electronic circuit forming a telemetry beacon 2. The electronic circuit 2 shown is represented by a printed circuit board, on which various components (not shown) are mounted. A light energy transmitter 3, preferably in the form of a light emitting diode, is mounted on the printed circuit board adjacent one portion of the housing. A light energy receiver 5, preferably in the form of a phototransistor, is mounted on the printed circuit board adjacent another portion 6 of the housing.

Also shown is a battery and antenna 7 disposed within the case. Access to the case is initially made by means of a circular door 8 having a peripheral lip fitted within a matching receiving portion of the case. Once the beacon and associated apparatus are placed within the housing, the door 8 is placed in its shown position and is permanently sealed in order to render the entire housing waterproof. Preferably the case is made of a plastics material whose translucency increases with decreasing thickness. The portions of the housing 4 and 6 are made thin so as to efficiently transmit light therethrough, by means of boring or molding holes 9 partly through the sides of the case. In the embodiment shown in FIG. 1, the holes 9 are formed on opposite sides of a wrist watch housing shaped housing.

An optical fiber 10 has its ends contained within the holes 9, preferably abutted against the bottoms of the holes. It is preferred that the ends of the optical fiber should be shaped to conform with the bottoms of the holes. In the embodiment shown, the ends of the optical fiber are formed at right angles to the axis of the optical fiber, so as to abut against conforming surfaces of the bottoms of the holes 9.

The optical fiber should be embedded within or otherwise protectively retained by a strap 12. The ends of the strap should be latched or otherwise fixed to the housing so as to retain the optical fibers in place. The exact manner of attaching the strap to the case does not form part of this invention. There are many well known ways of doing so, such as by fixing the ends of the strap to strap retaining pins in the manner of a normal watch strap. In that case the strap should be fitted into guides affixed to or formed by the housing so that the fiber ends will not move and become removed from their positions. Another manner of fixing the ends of the strap into position is by means of high friction or screw retention means which allow the strap to be pushed into position but not removed.

In operation, the beacon periodically sends out a pattern of light pulses via transmitter 3 which, providing the optical fiber has not been damaged, is immediately received by the receiver 5. This signal, received by the beacon from receiver 5, is compared therein and determines that the fiber and therefore the bracelet has not been cut. Periodically the beacon transmits a radio frequency signal in the normal manner indicating the nominal operation of the circuit and the location of the wearer or the object encircled.

Attempts to thwart the device by cutting the strap, and therefore the optical fiber, or holding the detector too close to a light source will fail, because a valid response pattern must be received which corresponds to the transmitted pulse pattern. Thus the system is inherently self-checking, since any loss of signal could indicate intentional damage, non-intentional damage, or functional failure.

Because the light is transmitted through a thin plastic, rather than through an actual opening into the case, the module is intrinsically and reliably waterproof, and offers significant advantages over openings which must be sealed with O-rings, gaskets, etc.

The optical emitter and detector, so positioned, offers communications capabilities to and from the beacon, even after it has been sealed in the module. Testing and programming, etc., can therefore be easily done without breaking the seal.

Since the optical fiber is inert and does not affect radio frequency signals, the optical fiber can remain connected during the manufacturing, testing and programming of the transmitter and will not affect the measurements of radiated frequency patterns.

It should also be noted that an external optical fiber coupled into the receiver or into another receiver which is adjacent another thin portion of the case can be used to transmit programming and/or identification codes to the beacon. Control signals can be applied thereto and resulting signals, such as test results, can be transmitted via the light energy transmitter, to an analyzing device.

Electrocardiogram or other biological function signals can be transmitted through a thin portion of the housing to the light energy receiver, for transmission via the beacon to a remote receiver. In case there are a limited number of frequencies in which various beacons are allowed to transmit, and in the situation in which two such transmitters are located in the same environs, a control signal can be transmitted using light energy through the waterproof case to the beacon in order to control it to change frequencies.

Figure 2:
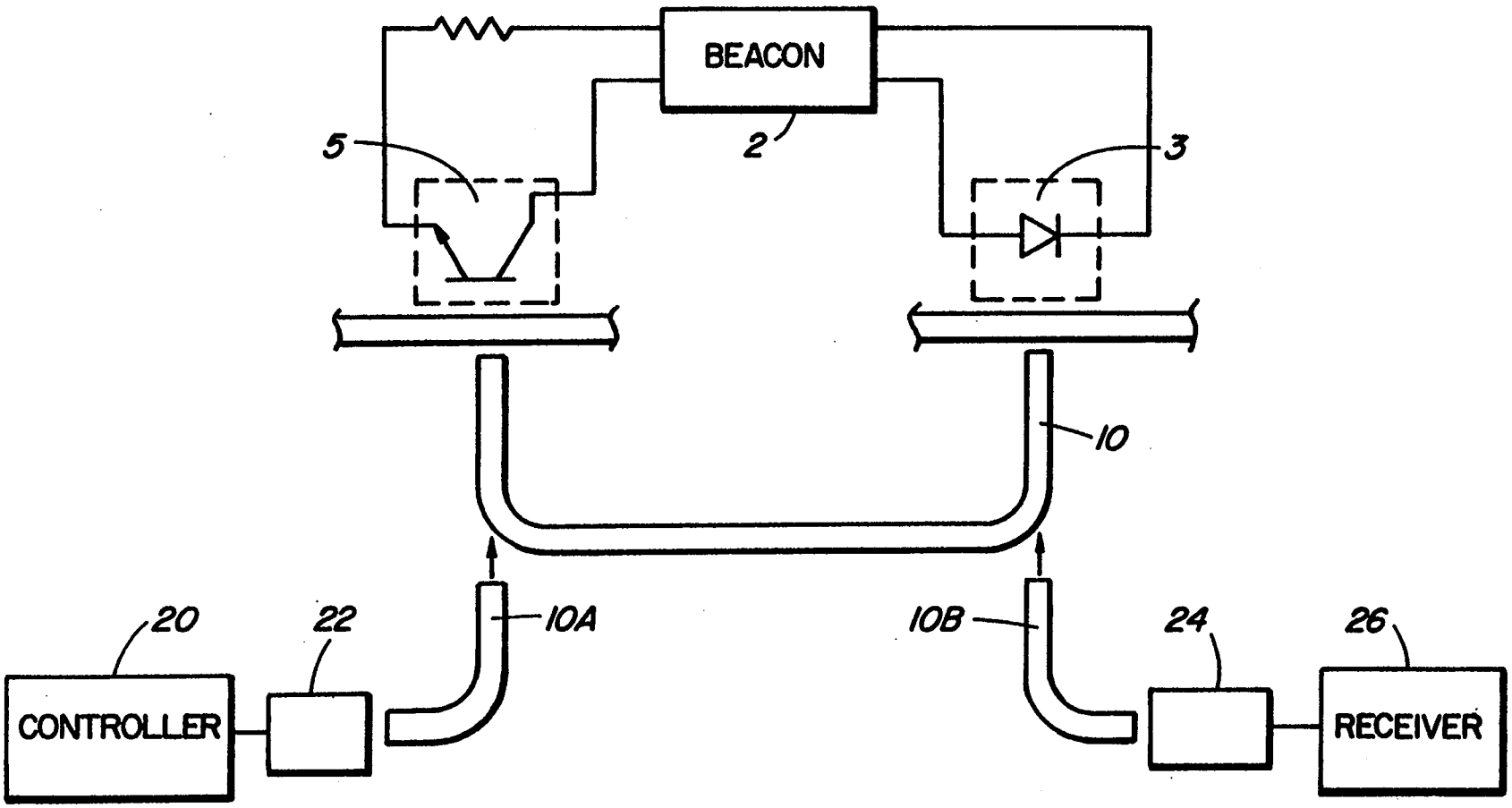

In FIG. 2 it will be seen that the optical fiber 10 can be removed, and substituted with another optical fiber 10*a* which is located so that its end is adjacent the light energy receiver 5. A controller 20 generates signals, for example, from a biological process detector such as an electrocardiogram, an electroencephalogram, etc., and transmits the signal to a light energy transmitting device 22, such as a light emitting diode. That device is coupled to the other end of optical fiber 10*a*. In this manner external signals may be coupled into the beacon 2 electronics.

The controller 20 may alternatively or in addition transmit control signals for beacon 2, such as an identification code modification signal, a mode operation control signal, a frequency change control signal, etc.

Similarly optical fiber 10*b* may be located in place of the end of optical fiber 10 adjacent transmitter 5, for receiving light energy transmitted by the beacon 2. The other end of optical fiber 10*b* is located adjacent an optical energy receiver 24, which is coupled to a receiver 26. In this manner, the identification code, mode, test results, stored data, etc. may be read out of beacon 2.

For example, with optical fibers 10*a* and 10*b* in place instead of optical fiber 10, the controller 20 can cause beacon 2 to store data transmitted to it by controller 20. This data may be electroencephalogram data. After a certain period of storage, such as twenty-four hours, with the coupling of optical fiber 10*b* into place, the controller 20 can cause the beacon to read the stored data. This is transmitted via optical transmitter 5, optical fiber 10*b*, optical receiving device 24 and receiver 26 for analysis of the stored data.

It will be recognized that the above facility provides significantly increased reliability over prior art structures since the case need not be opened in order to vary the frequency, in order to test it, etc., since in prior art systems the mere act of opening and closing the case and disturbing the circuit could change its characteristics and thus provide unreliable readings.

The use of the term telemetry beacon is intended not to be construed as being limited to a radio frequency transmitter which transmits regularly, by itself, at predetermined intervals. The term is intended to be construed to mean any electronic circuit, which is to be housed within a waterproof case. Such circuit, for example, could be one which transmits only upon interrogation, which transmits upon being triggered by a radio frequency or light energy signal, a circuit which merely stores signals received at its input, then which can be read, and which need not transmit by means of a radio frequency link. For example, biological function signals may be stored within the circuit over a period of time or at certain intervals, using the structure described, and then read out by means of an optical fiber link, also through the housing, in the manner described, to an external receiver and/or analyzing device.

A person understanding this invention may now conceive of alternative structures and embodiments or variations of the above. All of those which fall within the scope of the claims appended hereto are considered to be part of the present invention.

We claim:

1. A body strap for retaining a radio frequency beacon disposed in a housing to a body, comprising an optical fiber for encircling a body part, the housing having at least one light transmissive wall region, the ends of the optical fiber abutting an outside surface of said wall region, means for applying light energy to an inside surface of said at least one wall region whereby said light energy may be coupled through said wall region of the housing into one end of the optical fiber, and said coupled light energy may be received in the housing through said at least one wall region of the housing from the other end of the fiber.

2. A beacon and comparator disposed in a housing for attachment to a person or object, comprising a strap retaining an optical fiber for encircling a body part or said object with said strap, the housing having at least one light transmissive wall region, the ends of the optical fiber being abutted to an outside surface of said at least one wall region of the housing, means for generating light energy inside the housing adjacent an inside surface of said wall region for transmission through said at least one wall region into one end of the optical fiber, and means in the housing for receiving said light energy from the other end of the fiber through said at least one wall region, whereby a comparison may be made by the comparator of the generated and received light energy and thus the presence, absence of malfunction of the optical fiber determined.

3. A beacon as disposed in claim 2, in which portions of the housing are made of material sufficiently thin as to be translucent, the ends of the optical fiber abutting said portions of the housing so as to have light energy coupled from and coupled into the housing, a light energy source disposed inside the housing adjacent one of said portions, a light energy receiver disposed inside the housing adjacent the other of said portions, whereby light energy from said receiver may be coupled through the housing into the optical fiber and said coupled light energy may be coupled from the optical fiber through said housing, into said housing.

4. A beacon as defined in claim 3 in which said housing is waterproof.

5. A beacon as defined in claim 4 in which said housing is shaped similar to a wrist watch housing having edges which are much thinner than the diameter of the housing, said portions of the housing being located on opposite sides of the housing in said edges.

6. A beacon as defined in claim 5 further comprising circular holes extending from the outside of said edges of said housing part way through said housing, said portions being comprised of remaining housing walls having thickness from the bottom of said holes to the opposite wall of said housing, the diameters of said holes being similar to the diameter of the optical fiber, the ends of the optical fibers being disposed in said holes.

7. A beacon as defined in claim 6 in which the housing is comprised of plastics material.

8. A beacon as defined in claim 7, in which the optical fiber is imbedded in said strap, and protrudes at its ends.

9. A waterproof housing for retaining and protecting an electronic circuit, the housing having at least one wall portion which is comprised of translucent material, and means for coupling light energy modulated with a signal to be transmitted out of said housing or into said housing via said translucent material from one side of said translucent material to the other, disposed adjacent one side of said translucent wall portion, and means for receiving said light energy disposed adjacent the other side of said translucent wall portion, whereby said light energy may be coupled through the material of said translucent wall portion of said waterproof housing.

10. In combination with a housing as defined in claim 9, a radio frequency telemetry circuit contained within the housing, an optical fiber having one end adjacent the outside of said housing at said translucent portion, a light energy receiver connected to said telemetry circuit located adjacent the inside of said housing at said translucent portion, and means for applying light energy to the other end of the optical fiber representative of a signal to be transmitted to the telemetry circuit.

11. The combination defined in claim 10, in which said signal to be transmitted is representative of a biological function, for transmission by the telemetry circuit.

12. The combination defined in claim 11, in which said signal is a control signal for modifying operation of said telemetry circuit.

13. The combination as defined in claim 12 in which said control signal is a programming signal.

14. In combination with a housing as defined in claim 9, a circuit contained within the housing, a light energy transmitter connected to said circuit disposed within the housing adjacent said translucent portion for transmitting via light energy a signal representative of a state of said circuit, and a light energy receiver connected to said circuit disposed adjacent said translucent portion outside said housing for receiving said light energy signal, whereby said state of said circuit within the waterproof housing may be determined from said light energy signal received outside of said housing without opening said housing.

* * * * *